US007980549B2

(12) United States Patent
Hamaguchi

(10) Patent No.: US 7,980,549 B2
(45) Date of Patent: Jul. 19, 2011

(54) DOCUMENT FEEDER AND IMAGE FORMING DEVICE

(75) Inventor: Masanori Hamaguchi, Aichi (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 7 days.

(21) Appl. No.: 12/138,769

(22) Filed: Jun. 13, 2008

(65) Prior Publication Data

US 2008/0309008 A1 Dec. 18, 2008

(30) Foreign Application Priority Data

Jun. 13, 2007 (JP) ..... 2007-155835

(51) Int. Cl.
*B65H 3/06* (2006.01)

(52) U.S. Cl. ..... 271/118; 271/117; 271/10.04; 271/110; 271/265.01

(58) Field of Classification Search ..... 271/10.01, 271/10.04, 110, 265.01, 117, 118; 399/393, 399/371

See application file for complete search history.

(56) References Cited

U.S. PATENT DOCUMENTS

| | | | | |
|---|---|---|---|---|
| 5,058,874 | A * | 10/1991 | Miyoshi et al. | 271/4.1 |
| 5,139,252 | A * | 8/1992 | Morita et al. | 271/117 |
| 5,181,708 | A * | 1/1993 | Ruch | 271/21 |
| 6,390,463 | B1 * | 5/2002 | Iwago | 271/118 |
| 6,955,351 | B2 | 10/2005 | Sueoka | |
| 2003/0090050 | A1 * | 5/2003 | Sueoka | 271/10.01 |
| 2007/0020007 | A1 | 1/2007 | Azuma | |

FOREIGN PATENT DOCUMENTS

| | | | |
|---|---|---|---|
| JP | 1-236126 | A | 9/1989 |
| JP | 08-056280 | | 2/1996 |
| JP | 09-077309 | | 3/1997 |
| JP | 09-301573 | | 11/1997 |
| JP | 11-208936 | | 8/1999 |
| JP | HEI11-255375 | A | 9/1999 |
| JP | 2000296945 | A | 10/2000 |
| JP | 2001063855 | A | 3/2001 |
| JP | 2001294343 | A | 10/2001 |
| JP | 2003146480 | A | 5/2003 |
| JP | 2007-051005 | | 3/2007 |

OTHER PUBLICATIONS

Notification of Reasons of Rejection for Application No. 2007-155835, mailed Feb. 17, 2009, 5 pages.

JP Office Action dtd Mar. 9, 2010, JP Appln. 2007-155835, English Translation.

* cited by examiner

*Primary Examiner* — Stefanos Karmis
*Assistant Examiner* — Ernesto Suarez
(74) *Attorney, Agent, or Firm* — Banner & Witcoff, Ltd.

(57) ABSTRACT

A document feeder configured to feed a document in a first direction includes a tray configured to load a document or a set of documents on a loading surface thereof, first and second contact portions disposed to contact the document on the loading surface, and a detecting unit configured detect whether a document is loaded on the loading surface, the detecting unit including an actuator provided between the first contact portion and the second contact portion, the actuator projecting upward from the loading surface and being configured to be moved down due to contact with the document on the loading surface.

17 Claims, 6 Drawing Sheets

FIG. 4
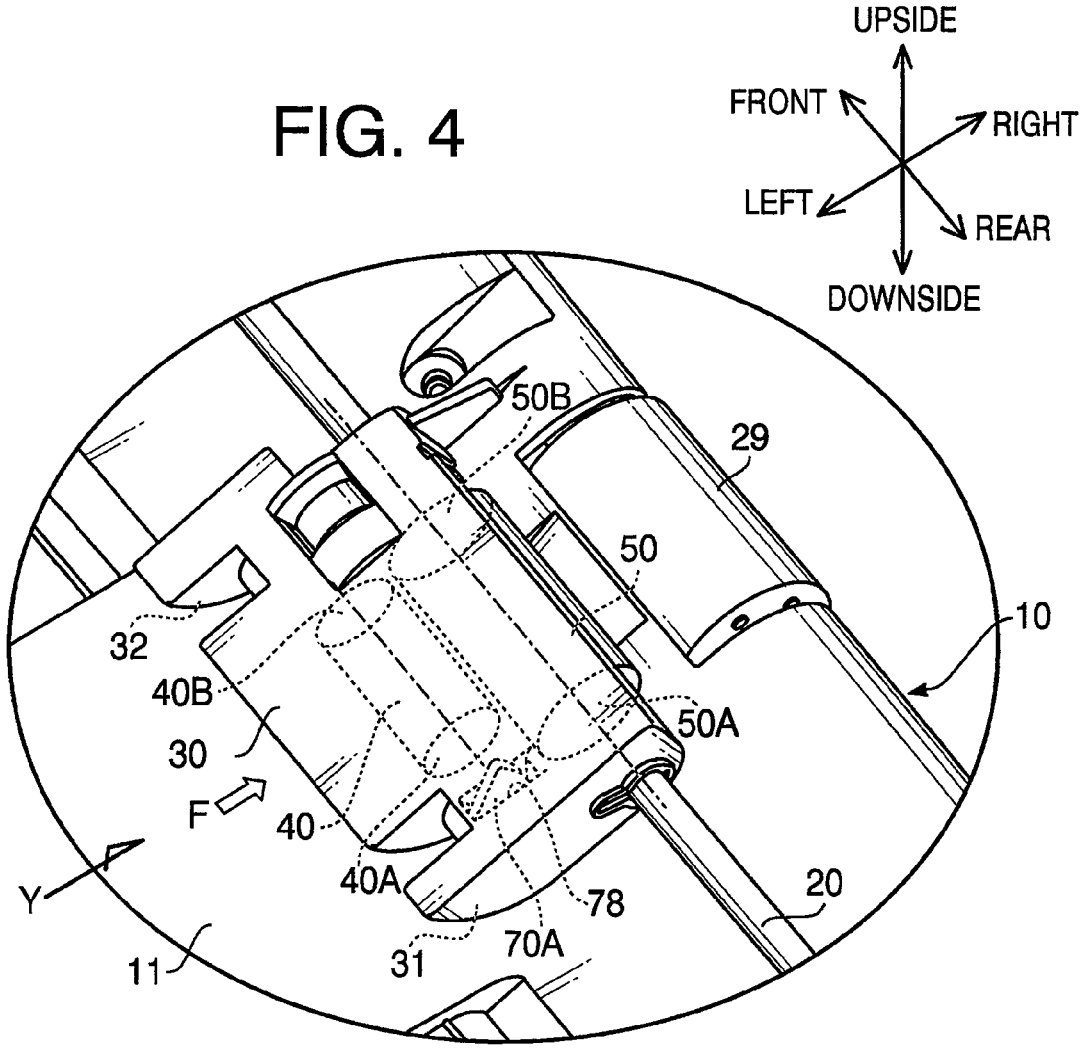
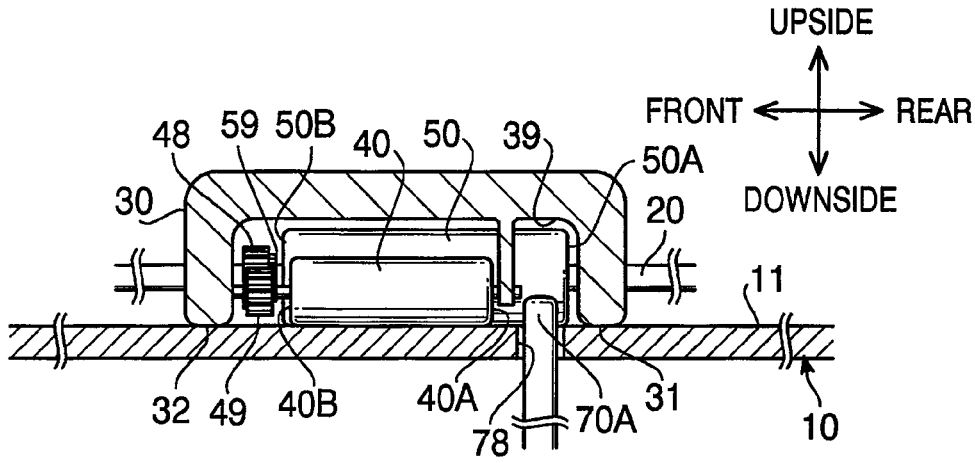
FIG. 5

DOCUMENT FEEDER AND IMAGE FORMING DEVICE

CROSS-REFERENCE TO RELATED APPLICATION

This application claims priority under 35 U.S.C. §119 from Japanese Patent Application No. 2007-155835 filed on Jun. 13, 2007. The entire subject matter of the application is incorporated herein by reference.

BACKGROUND

1. Technical Field

The following description relates to one or more document feeders provided to an image forming device.

2. Related Art

Japanese Patent Provisional Publication No. 2007-51005 (hereinafter referred to as '005 Publication) discloses an automatic document feeder, which is applied to an image forming device having a scanner unit and provided with a tray having a loading surface on which a document is placed.

Further, the automatic document feeder is provided with a spindle, holder, paper feed roller, and separation roller so as to supply the document on the loading surface to the scanner unit on a sheet-by-sheet basis (see FIG. 2 of '005 Publication).

The spindle is provided to extend, above the tray, in a direction that is parallel to the loading surface and perpendicular to a carrying direction in which the document is conveyed, and to be rotated to carry the document. The holder is swingably provided to the spindle. The paper feed roller is rotatably provided to the holder at an upstream side in the carrying direction so as to be driven in accordance with the rotation of the spindle. The separation roller is provided at a downstream side in the carrying direction within the holder so as to be rotated integrally with the spindle.

Further, the automatic document feeder includes a detecting unit configured to detect whether a document is placed in the tray (see FIGS. 2 to 4 of '005 Publication). Specifically, the detecting unit has an actuator protruding upward from the tray in a position away from the paper feed roller obliquely toward an upstream side in the carrying direction. The actuator is swingably supported at a backside of the loading surface so as to be moved owing to contact with the document on the loading surface. The detecting unit checks whether a document is placed in the tray by detecting, with a sensor, the downward movement of the actuator caused by the weight of the document in the tray.

The automatic document feeder configured as above checks with the detecting unit whether a document is placed in the tray, when receiving an instruction to supply the document to the scanner. When detecting the document placed in the tray, the aforementioned automatic document feeder causes the spindle, paper feed roller, and separation roller to rotate and feeds the document to the scanner on a sheet-by-sheet basis.

SUMMARY

However, sometimes the aforementioned automatic document feeder cannot certainly detect whether a document is placed in the tray.

Specifically, a document set in the automatic document feeder is sometimes curled when the document is bent by a user or colorant is transferred widely onto one side of the document for photographic image printing. When the curled document is placed on the loading surface, the actuator, which is located away from the paper feed roller, might not be moved down since the document is curled up above the actuator. In this case, even though the document is placed in the tray, the detecting unit cannot detect it, and it is impossible to perform an automatic paper feeding operation. This kind of failure is particularly likely to be caused when the document is curled in a direction perpendicular to the carrying direction.

Aspects of the present invention are advantageous to provide one or more improved document feeders and image forming devices that make it possible to more certainly detect whether a document is placed in a tray.

According to aspects of the present invention, a document feeder, which is configured to feed a document in a first direction, includes a tray configured to load a document or a set of documents on a loading surface thereof, a spindle rotatably provided over the tray to extend in a second direction that is parallel to the loading surface and perpendicular to the first direction, a holder swingably provided to the spindle, a feed roller rotatably provided to the holder at an upstream side in the first direction, the feed roller being configured to be driven by the spindle in contact with the document on the loading surface and feed the document in the first direction, a separation roller provided at a downstream side in the first direction within the holder, the separation roller being configured to be rotated integrally with the spindle and separate a document from the documents on the loading surface on a sheet-by-sheet basis, first and second contact portions disposed along the second direction to contact the document on the loading surface, and a detecting unit configured to detect whether a document is loaded on the loading surface, the detecting unit including an actuator provided between the first contact portion and the second contact portion, the actuator projecting upward from the loading surface and being configured to be moved down due to contact with the document on the loading surface.

In some aspects of the present invention, it is possible to press the document against the loading surface of the tray with the first and second contact portions. Further, the actuator establishes contact with the document between the first and second contact portions. Therefore, even though a curled document is placed on the loading surface of the tray, the actuator contacts the document made flat by the first and second contact portions, and is certainly moved down. Accordingly, the detecting unit of the document feeder can certainly detect whether a document is loaded on the loading surface, even when the document is curled at both ends thereof in the second direction.

According to another aspect of the present invention, an image forming device includes a scanner unit configured to scan an image formed on a document, and a document feeder configured to feed a document in a first direction to the scanner unit. The document feeder includes a tray configured to load a document or a set of documents on a loading surface thereof, a spindle rotatably provided over the tray to extend in a second direction that is parallel to the loading surface and perpendicular to the first direction, a holder swingably provided to the spindle, a feed roller rotatably provided to the holder at an upstream side in the first direction, the feed roller being configured to be driven by the spindle in contact with the document on the loading surface and feed the document in the first direction, a separation roller provided at a downstream side in the first direction within the holder, the separation roller being configured to be rotated integrally with the spindle and separate a document from the documents on the loading surface on a sheet-by-sheet basis, first and second contact portions disposed along the second direction to contact the document on the loading surface, and a detecting unit configured to detect whether a document is loaded on the loading surface, the detecting unit including an actuator provided between the first contact portion and the second contact portion, the actuator projecting upward from the loading surface and being configured to be moved down due to contact with the document on the loading surface.

With the image forming device configured as above, the same effect as the aforementioned document feeder can be provided.

BRIEF DESCRIPTION OF THE ACCOMPANYING DRAWINGS

FIG. 4 is a partially enlarged perspective view of FIG. 3.

FIG. 5 is a cross-sectional view schematically showing the tray, spindle, holder, paper feed roller, separation roller, and actuator of the automatic document feeder when viewed in a direction of an arrow Y shown in FIG. 4 in the first embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, first and second embodiments according to aspects of the present invention will be described with reference to the accompanying drawings.

First Embodiment

Figure 1:
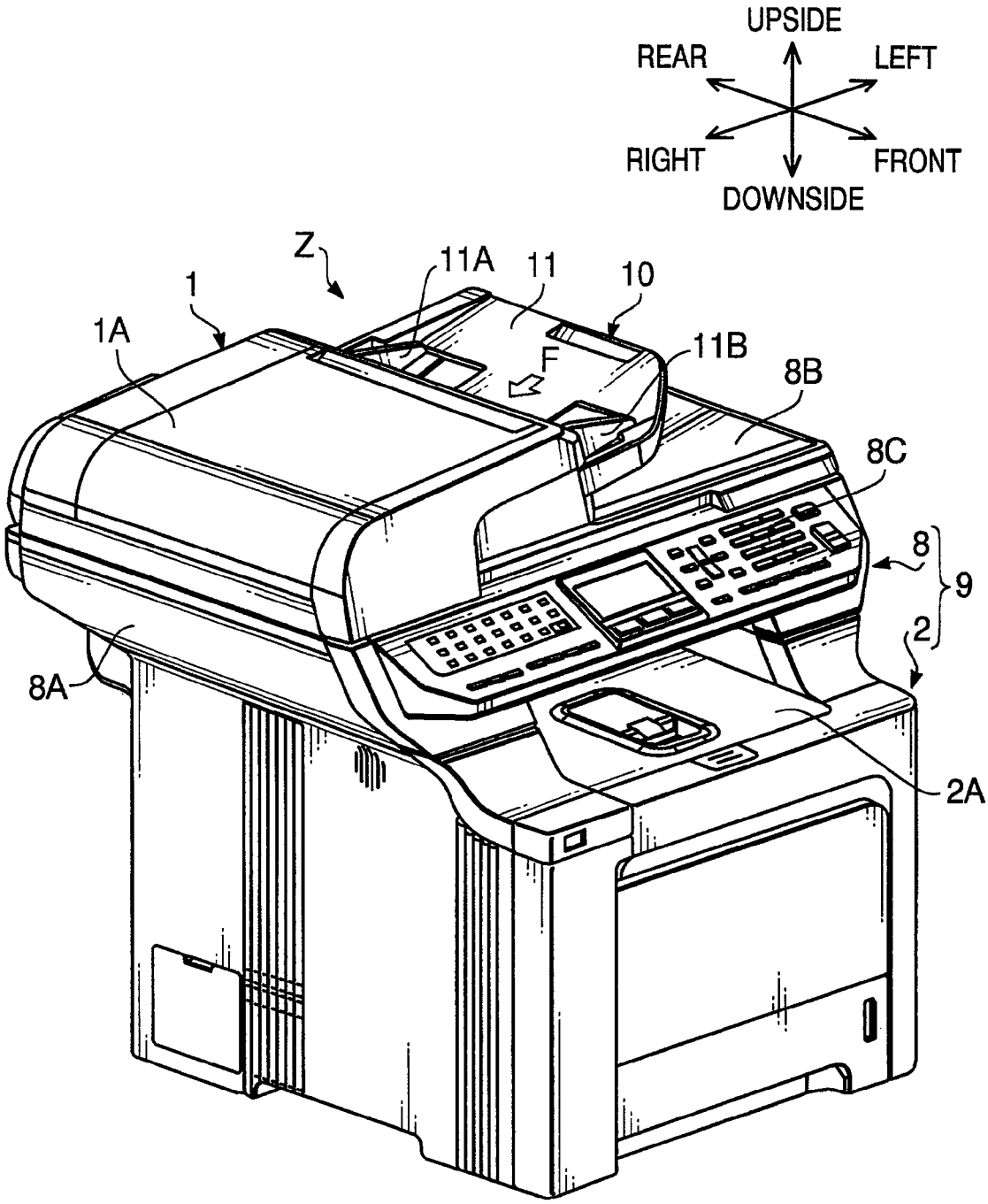
FIG. 1 is a perspective view of an image forming device to which an automatic document feeder is applied in a first embodiment according to one or more aspects of the present invention.

As shown in FIG. 1, an automatic document feeder (ADF) 1 in a first embodiment is applied to an image forming device 9. The image forming device 9, generally referred to as a Multi Function Peripheral (MFP), includes an image forming unit 2 provided at a lower portion thereof, and a scanner unit 8 provided above the image forming unit 2. The image forming device 9 may be applied to other image forming apparatuses, such as facsimile machines, and copiers. The automatic document feeder 1 in the first embodiment is provided above the scanner unit 8. Hereinafter, each of the constituent elements will be explained. It is noted that each of a front-to-rear direction, right-to-left direction, and upside-to-downside direction of the image forming device 9 and automatic document feeder 1 is defined under the assumption that an operation panel 8C is disposed at a front side, as shown in FIG. 1. Additionally, a front-to-rear direction, right-to-left direction, and upside-to-downside direction shown in FIGS. 2 to 8 correspond to those indicated in FIG. 1, respectively.

<Image Forming Unit>

The image forming unit 2 is, as illustrated in FIG. 1, substantially box-shaped, and includes therein an image forming unit body (not shown), and a paper feed cassette and paper feed mechanism (not shown) for supplying a paper to the image forming unit body. The image forming unit body is configured in a known manner used for an electrophotographic method, inkjet method, and other general image forming methods. Further, the paper feed cassette and paper feed mechanism are also configured in a known manner. Therefore, detailed descriptions for the image forming unit body, paper feed cassette, and paper feed mechanism will be omitted.

At an upper face side of the image forming unit 2, a catch tray 2A into which a paper is discharged toward the front side from the rear side thereof is provided in a recessed form. The image forming unit 2 is configured to form an image on a paper based upon image data externally transmitted or image data of an original document scanned by the scanner unit 8, and to discharge the paper with the image formed thereon into the catch tray 2A.

<Scanner Unit>

As shown in FIG. 1, the scanner unit 8 is flatbed type, and provided with a casing 8A mounted on the image forming unit 2 so as to cover an upper face of the catch tray 2A.

Figure 2:
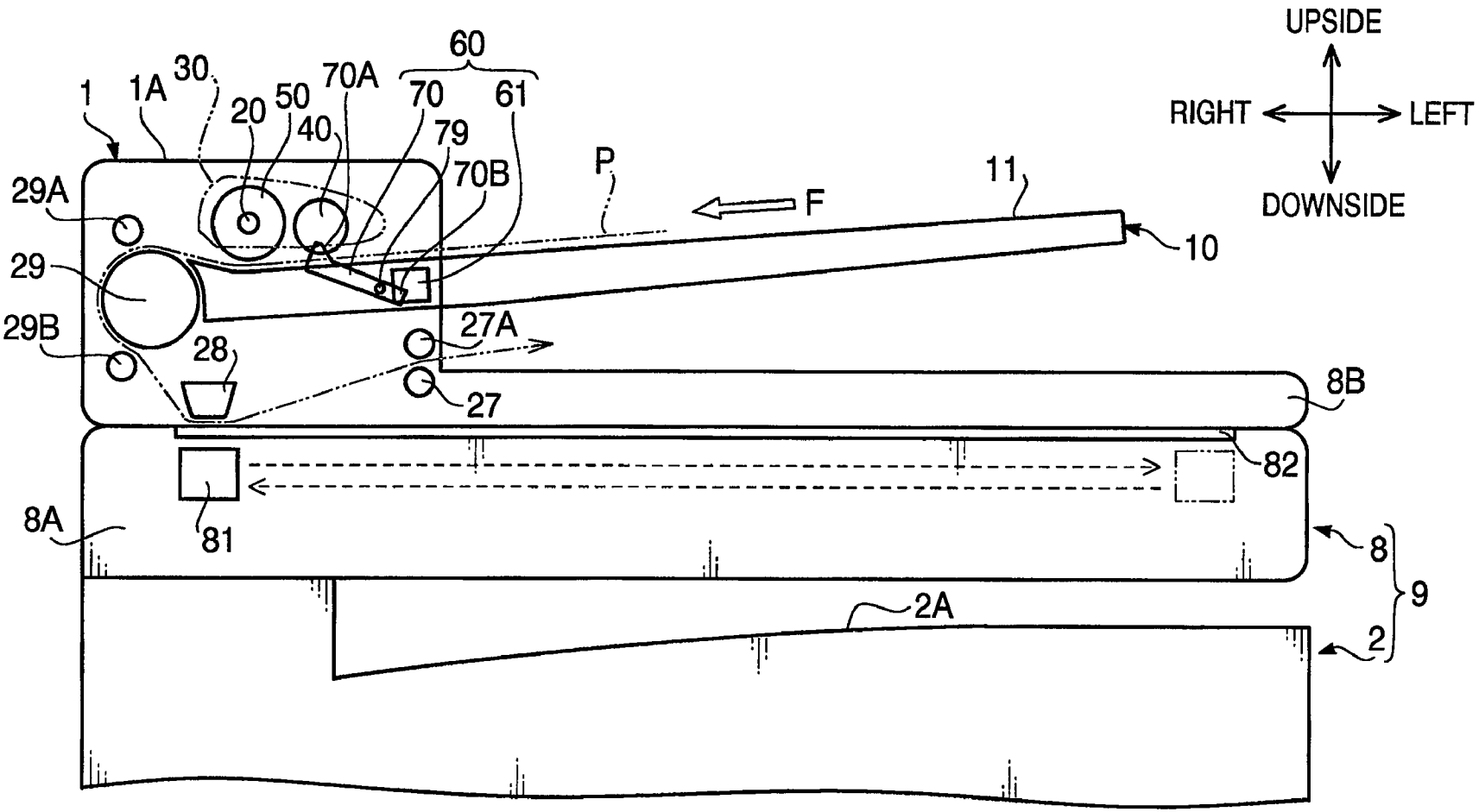
FIG. 2 is a schematic cross-sectional view of a scanner unit in the first embodiment according to one or more aspects of the present invention.

As illustrated in FIG. 2, the casing 8A is formed in a shape of a box whose top face is opened, and incorporates an image sensor 81 therein. The top face of the casing 8A is covered with a platen glass 82 on which a document is placed.

The image sensor 81 is a linear type sensor with a plurality of photodiodes aligned in the front-to-rear direction. Further, the image sensor 81, normally located at the right side in the casing 8A, is configured to be shifted in the right-to-left direction with a scanning mechanism (not shown).

As shown in FIGS. 1 and 2, a document cover 8B is provided above the casing 8A to cover the platen glass 82. An operation panel 8C for operating the image forming unit 2 and the scanner unit 8 is provided at a front end side of an upper face of the document cover 8B. Further, the automatic document feeder 1 to be described in detail below is provided at a right side of the upper face. In addition, a rear end portion of the document cover 8B is swingably supported by a hinge (not shown) provided at a rear end of the casing 8A. The document cover 8B is configured to be opened and closed by a user vertically moving a front end of the document cover 8B.

The scanner unit 8 configured as above can scan an original document on a sheet-by-sheet basis. When the document cover 8B is opened, a document is placed on the platen glass 82, and the document cover 8B is closed, the document is scanned by the image sensor 81 that is moved in the right-to-left direction.

In addition, the scanner unit 8 can scan two or more documents successively through the automatic document feeder 1. When the documents are automatically supplied to the scanner unit 8 along a carrying route P (see FIG. 2) on a sheet-by-sheet basis through the automatic document feeder 1, the documents pass over the image sensor 81 that remains stationary to be scanned.

<Automatic Document Feeder>

As shown in FIG. 2, the automatic document feeder 1 includes a tray 10, a spindle 20, a holder 30, a paper feed roller 40, a separation roller 50, a detecting unit 60, a turning-down roller 29, a guide plate 28, a discharge roller 27, and driven rollers 29A, 29B, and 27A.

Figure 3:
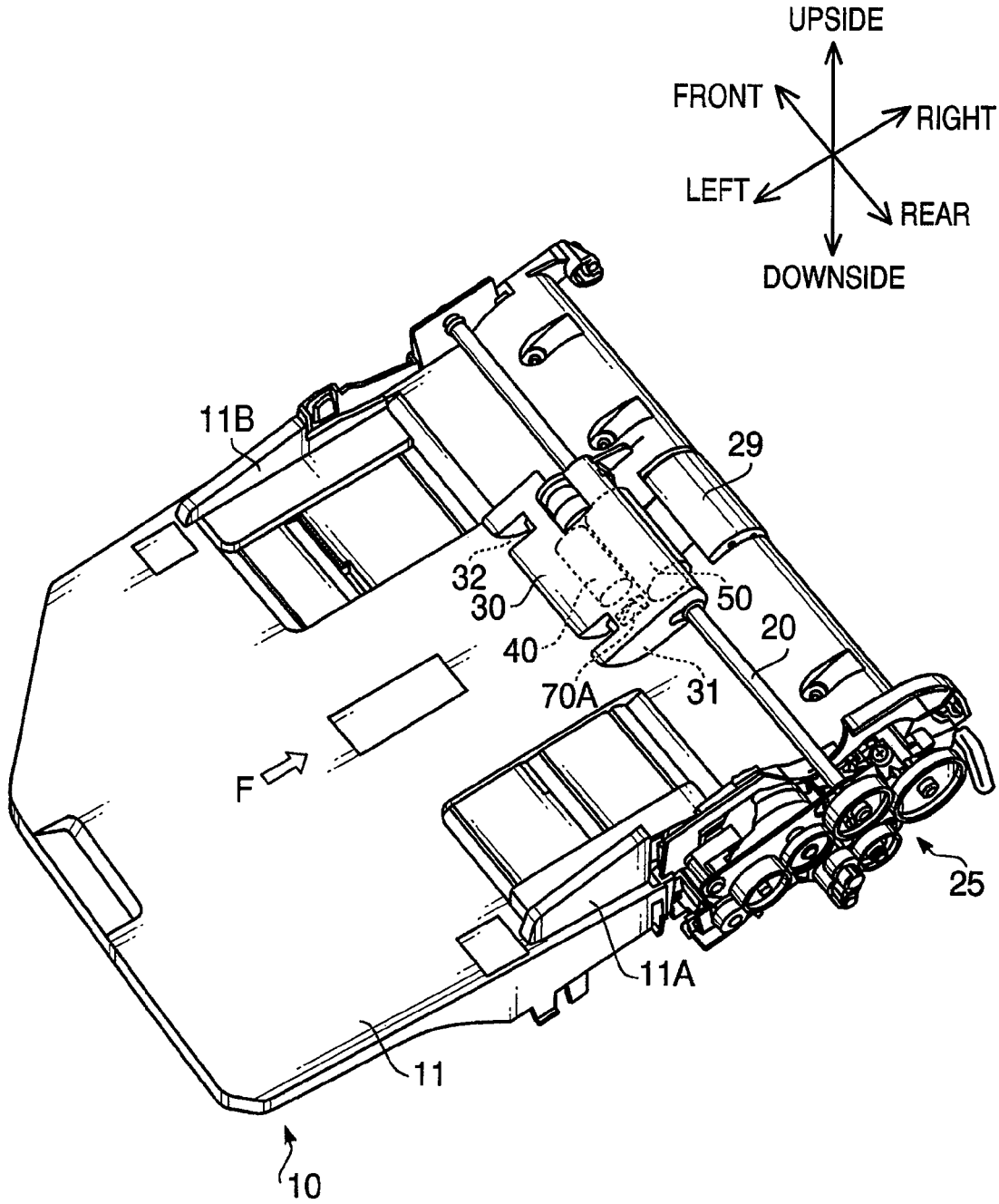
FIG. 3 is a perspective view showing a tray, spindle, holder, paper feed roller, separation roller, and actuator of the automatic document feeder when viewed in a direction of an arrow Z shown in FIG. 1 in the first embodiment according to one or more aspects of the present invention.

As shown in FIGS. 2 and 3, the tray 10 is a plastic body formed in a substantially plate shape. A loading surface 11 on which a document is placed is formed at an upper face side of the tray 10. As illustrated in FIG. 2, a right end portion of the tray 10 is supported as a cantilever by an ADF housing 1A provided on a right upper face of the document cover 8B. The loading surface 11 is tilted with the right side thereof somewhat lower than the left side. The tray 10 is located above the upper face of the document cover 8B with some clearance therefrom, and is configured to discharge a document fed along the carrying route P finally onto the upper face of the document cover 8B.

As shown in FIG. 3, the tray 10 includes a pair of width regulating guides 11A and 11B mutually facing at both ends of the tray 10 in a direction perpendicular to an F direction (left-to-right direction in FIG. 3, which is simply referred to as a carrying direction hereinafter) in which the document placed on the loading surface 11 is carried. The width regulating guides 11A and 11B are configured to regulate the location of the document on the basis of a center in a width direction (front-to-rear direction in FIG. 3) of the loading surface 11. Therefore, even though a different-sized document is placed on the loading surface 11, its center in the width direction of the document aligns with the center in the width direction of the loading surface 11.

As shown in FIGS. 2 and 3, the spindle 20, the holder 30, the paper feed roller 40, and the separation roller 50 are provided above a right end portion of the tray 10 in the ADF housing 1A.

The spindle 20 is a long metal cylindrical shaft body provided to extend along the loading surface 11 perpendicularly to the carrying direction F. As shown in FIG. 3, a front end and a rear end of the spindle 20 are rotatably supported by the tray 10. Further, the rear end of the spindle 20 is configured to be driven by a driving mechanism 25 and rotated to convey a document in the carrying direction F.

Figure 6:
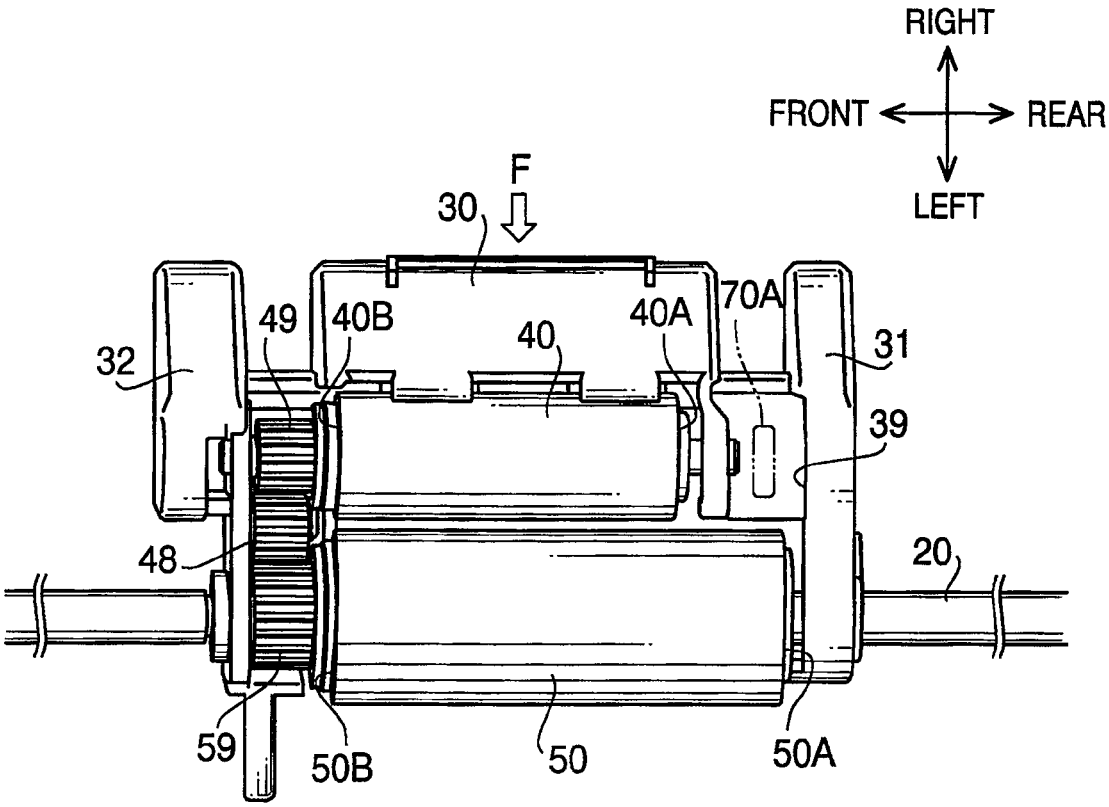
FIG. 6 is a bottom view showing the tray, spindle, holder, paper feed roller, separation roller, and actuator of the automatic document feeder in the first embodiment according to one or more aspects of the present invention.

As shown in FIGS. 4 to 6, the holder 30 is a plastic body formed in a substantially box shape that is provided at a center portion of the spindle 20. The spindle 20 is inserted into the holder 30 at a downstream side thereof in the carrying direction F. Further, the holder 30 is vertically swingable at an upstream side thereof in the carrying direction F. Therefore, the upstream side of the holder 30 in the carrying direction F is configured to be normally swung down by its own weight.

As shown in FIG. 6, at a backside (downside) of the holder 30, at the downstream side in the carrying direction thereof, the separation roller 50 is fixed around the spindle 20 so as to be rotatable integrally with the spindle 20. Additionally, at the upstream side of the holder 30 in the carrying direction, the paper feed roller 40 is supported rotatably around an axis along the spindle 20.

Figure 7:
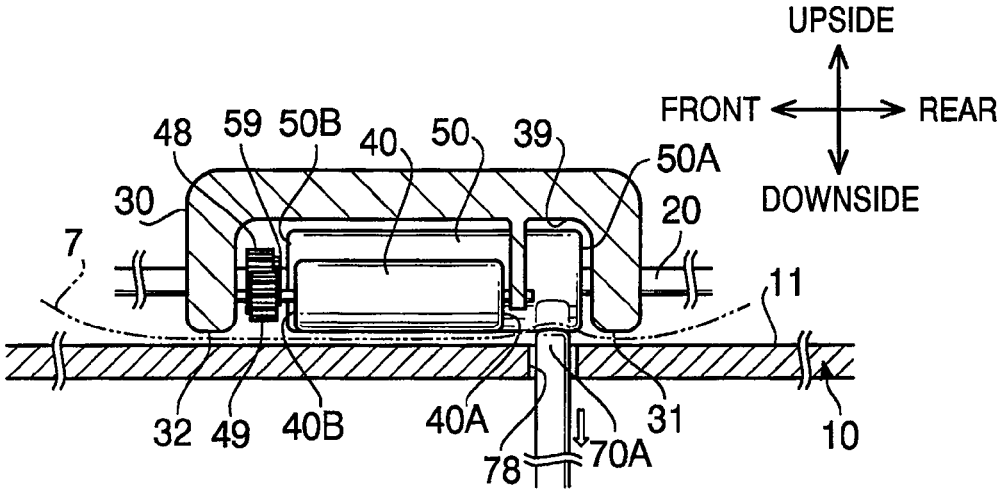
FIG. 7 is a cross-sectional view schematically showing the tray, spindle, holder, paper feed roller, separation roller, and actuator of the automatic document feeder when viewed in the direction of the arrow Y shown in FIG. 4 (in a state where a document, is placed in the tray) in the first embodiment according to one or more aspects of the present invention.

The paper feed roller 40 is configured to be rotated in contact with an uppermost surface of the document placed on the loading surface 11 and to feed the document in the carrying direction F. The separation roller 50 is configured to carry the document fed by the paper feed roller 40 while pressing the document against a separation pad (not shown) provided at the tray 10 side to face the separation roller 50 so as to separate the document on a sheet-by-sheet basis. As described above, the upstream side of the holder 30 in the carrying direction F is configured to be normally swung down due to its own weight. Hence, as shown in FIGS. 5 and 7, the paper feed roller 40 and separation roller 50 establish contact with the loading surface 11 or a document 7 placed on the loading surface 11 at the center in the width direction of the loading surface 11.

Additionally, as shown in FIG. 6, a first contact portion 31 (located at the rear side in FIG. 6) and a second contact portion 32 (located at the front side in FIG. 6) are formed at the backside (downside) of the holder 30, outside both side ends 40A and 40B of the paper feed roller 40 in a direction perpendicular to the carrying direction F. The first contact portion 31 and second contact portion 32 are surfaces curved downward so as to slidingly contact the document. Since the upstream side of the holder 30 in the carrying direction F is normally swung down due to its own weight as described above, the first contact portion 31 and second contact portion 32 establish contact with the loading surface 11 or the document 7 placed on the loading surface 11 at the center in the width direction of the loading surface 11, as shown in FIGS. 5 and 7.

Further, as shown in FIG. 6, at the backside (downside) of the holder 30, an actuator accommodating room 39 is provided, in a recessed form, between the side end 40A of the paper feed roller 40 and the first contact portion 31. The actuator accommodating room 39 is configured to house therein one end 70A of a below-mentioned actuator 70.

A driving gear 59 is fixed to a side end 50B of the separation roller 50 at the second contact portion 32 side. In addition, a driven gear 49 is fixed to the side end 40B of the paper feed roller 40 at the second contact portion 32 side. Further, an intermediate gear 48 is provided between the driving gear 59 and driven gear 49. The intermediate gear 48 is configured to transmit a driving force from the driving gear 59 to the driven gear 49, and rotatably supported by the holder 30. Therefore, when the separation roller 50 is rotated integrally with the spindle 20, the driven gear 49 is thereby rotated via the driving gear 59 and intermediate gear 48 in the same direction as the separation roller 50. As a consequence, the paper feed roller 40 is rotated in the same direction as the spindle 20 and the separation roller 50.

The detecting unit 60 is configured to detect whether a document is placed in the tray 10, and, as illustrated in FIG. 2, provided with a photo-micro-sensor 61 provided at a backside of the loading surface 11, and a substantially stick-shaped actuator 70 supported at the backside of the loading surface 11 swingably around a swing shaft 79.

As shown in an enlarged view of FIG. 4, the end 70A of the actuator 70 has a substantially triangle shape when viewed in the front-to-rear direction. Further, the end 70A of the actuator 70 projects upward from an opening 78 formed in the tray 10. As shown in FIG. 7, the opening 78 is configured as a through hole formed beneath the actuator accommodating room 39 of the holder 30 so as to be located between a side end 50A of the separation roller 50 at the first contact portion 31 side and the side end 40A of the paper feed roller 40 at the first contact portion 31 side when viewed in the carrying direction F. Thereby, the end 70A of the actuator 70 projects into the actuator accommodating room 39.

The end 70A of the actuator 70 disposed as above is located between the first contact portion 31 and second contact portion 32. Additionally, the end 70A of the actuator 70 is located between the side end 40A of the paper feed roller 40 and the first contact portion 31. Further, the end 70A of the actuator 70 is located between the side end 50A of the separation roller 50 at the first contact portion 31 side and the side end 40A of the paper feed roller 40 at the first contact portion 31 side. The reason why the end 70A of the actuator 70 is configured to be located as above is, as described below, to enable the detecting unit 60 to more certainly perform a detecting operation.

In the detecting unit 60 configured as above, when a document is placed on the loading surface 11, as shown in FIG. 7, the end 70A of the actuator 70 contacts the document 7 and is displaced downward by the weight of the document 7. At this time, the other end 70B of the actuator 70 oppositely swings to block an optical path of sensing light of the photo-micro-sensor 61. Consequently, the detecting unit 60 senses the displacement of the actuator 70 with the photo-micro-sensor 61 and detects whether a document is placed in the tray 10.

As shown in FIGS. 2 and 3, the turning-down roller 29 is a large diameter roller provided at a downstream side of the separation roller 50 on the carrying route P. Further, the turning-down roller 29 is configured to turn down and carry a document in a substantially U-shape with the driven rollers 29A and 29B disposed radially outside the turning-down rollers 29.

The guide plate 28 is, as shown in FIG. 2, provided above the image sensor 81 located at the right side end portion in the casing 8A to guide a document conveyed along the carrying route P into a position near the image sensor 81.

As illustrated in FIG. 2, the discharge roller 27 is provided at the most downstream side on the carrying route P. The discharge roller 27 is configured to discharge the document completely scanned onto an upper face of the document cover 8B with the driven roller 27A.

In the automatic document feeder 1 configured as above in the first embodiment, as shown in FIG. 7, when the document 7 is placed on the loading surface 11, the upstream side of the holder 30 in the carrying direction F is swung down due to its own weight, the paper feed roller 40, the separation roller 50, and the first and second contact portions 31 and 32 of the holder 30 contact the document 7. At this time, the end 70A of the actuator 70 also contacts the document 7 and is moved down due to the weight of the document 7.

Then, when receiving an instruction to supply a document to the scanner unit 8, the automatic document feeder 1 controls the detecting unit 60 to check whether a document is placed in the tray 10 by detecting the displacement of the end 70A of the actuator 70 with the photo-micro-sensor 61.

Next, the automatic document feeder 1 controls the driving mechanism 25 in response to the detection result of the detecting unit 60 to rotate the spindle 20 such that the document 7 is conveyed. Thereby, the paper feed roller 40 and separation roller 50 are as well rotated in the same direction as the spindle 20, and the document 7 placed on the loading surface 11 of the tray 10 is supplied on a sheet-by-sheet basis along the carrying route P. Thus, the document 7 is conveyed by the turning-down roller 29, driven rollers 29A and 29B, and guide plate 28, then scanned by the image sensor 81 while passing over the image sensor 81, and thereafter discharged onto the upper face of the document cover 8B by the discharge roller 27 and driven roller 27A.

In this manner, the scanner unit 8 can automatically scan two or more documents with the automatic document feeder 1.

As described above, the automatic document feeder 1 of the first embodiment can press the document 7 against the loading surface 11 of the tray 10 with the first contact portion 31 provided at one end side of the holder 30 in the direction perpendicular to the carrying direction F and the second contact portion 32 provided at the other end side of the holder 30. Further, the end 70A of the actuator 70 contacts the document 7 between the first contact portion 31 and the second contact portion 32. Therefore, as shown in FIG. 7, when the document 7 is placed on the loading surface 11, the end 70A of the actuator 70 contacts the document 7 made flat by the first contact portion 31 and the second contact portion 32 therebetween, and is certainly shifted down. Hence, the detecting unit 60 can certainly detect whether the document 7 is placed in the tray 10. The aforementioned effect is certainly provided even when the document 7 is curled at both ends thereof in the direction perpendicular to the carrying direction F.

Accordingly, the automatic document feeder 1 in the first embodiment can more certainly detect whether a document is placed in the tray 10.

Additionally, in the automatic document feeder 1, the first contact portion 31 and the second contact portion 32 are provided to the holder 30 so as to be located outside both the ends 40A and 40B of the paper feed roller 40 in the direction perpendicular to the carrying direction F. Further, the end 70A of the actuator 70 is provided between the side end 40A of the paper feed roller 40 and the first contact portion 31. Thereby, in the automatic document feeder 1 of the first embodiment, the end 70A of the actuator 70 can be located so as to not overlap the paper feed roller 40 when viewed in the carrying direction F. In other words, as the end 70A of the actuator 70 is disposed within a space occupied by the holder 30, the automatic document feeder 1 can be prevented from extending in the carrying direction F. In addition, the end 70A of the actuator 70 can be disposed within a short range between the side end 40A of the paper feed roller 40 and the first contact portion 31. Therefore, it is possible to easily make the document to be flat, even though the document is curled in the direction perpendicular to the carrying direction F. Hence, the automatic document feeder 1 in the first embodiment can certainly provide the aforementioned effect expected in the present invention.

Further, in the automatic document feeder 1 of the first embodiment, the end 70A of the actuator 70 is disposed between the side end 50A of the separation roller 50 and the side end 40A of the paper feed roller 40, when viewed in the carrying direction F. Therefore, in the automatic document feeder 1, the actuator 70 can be located at an upstream side in the carrying direction F within such a range in the direction perpendicular to the carrying direction F that the separation roller 50 presses the document 7 against the loading surface 11. Thus, the aforementioned effect can more certainly be provided.

Further, in the automatic document feeder 1 of the first embodiment, the driving gear 59 and driven gear 49 are disposed at the second contact portion 32 side. Therefore, it is possible to make short a distance between the side end 40A of the paper feed roller 40 and the first contact portion 31. Thereby, in the automatic document feeder 1, since the actuator 70 can be disposed within a short range between the both the side end 40A and the first contact portion 31 located close to each other, the aforementioned effect can further certainly be provided.

Second Embodiment

Figure 8:
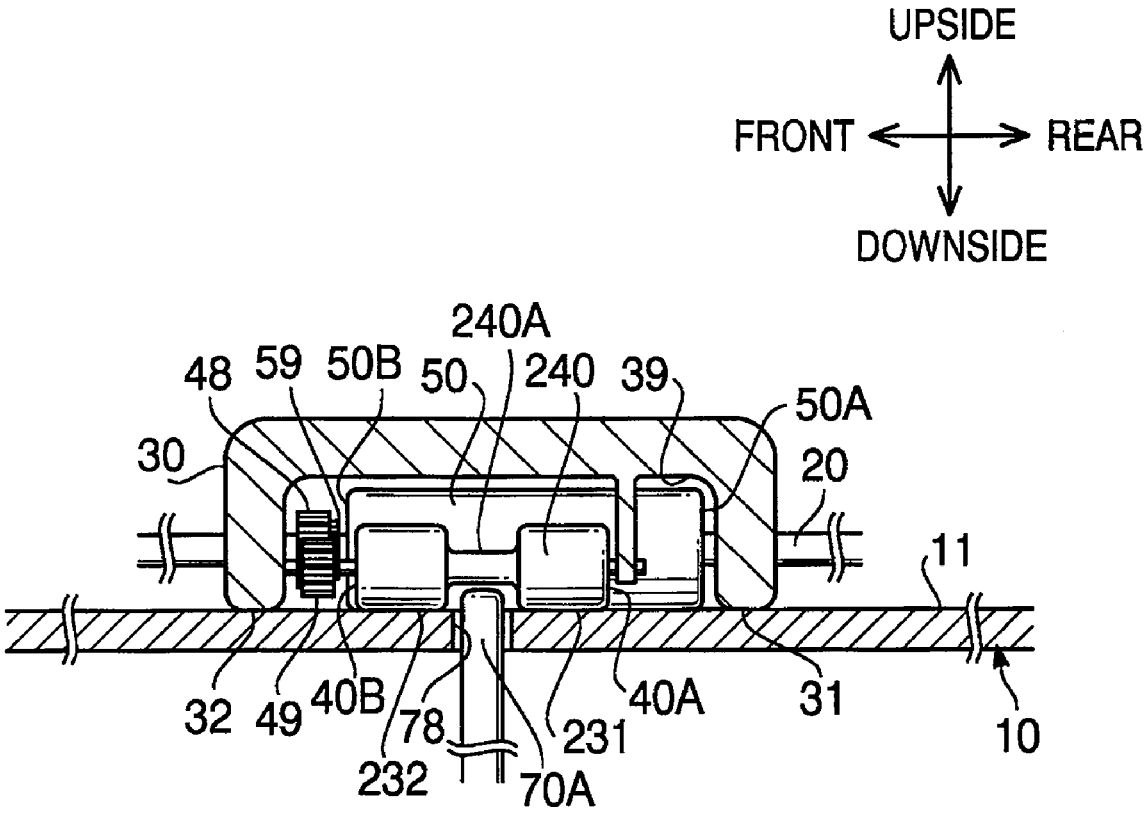
FIG. 8 is a cross-sectional view schematically showing a tray, a spindle, a holder, a separation roller, an actuator, and a paper feed roller of an automatic document feeder in a second embodiment according to one or more aspects of the present invention.

In an automatic document feeder in a second embodiment, the paper feed roller 40 of the automatic document feeder 1 in the first embodiment is changed to a paper feed roller 240 as shown in FIG. 8. Further, the location of the actuator 70 of the automatic document feeder 1 in the first embodiment is changed to a position under the paper feed roller 240. The other configurations are the same as the automatic document feeder 1 in the first embodiment. Therefore, in the following description, explanation on different respects between the first embodiment and the second embodiment will be given, and that on the same respects will be omitted.

In the second embodiment, as shown in FIG. 8, the paper feed roller 240 is a grooved roller with a groove 240A formed at a center thereof in the direction perpendicular to the carrying direction (i.e., a front-to-rear direction in FIG. 8).

In the second embodiment, a cylindrical surface at the rear side of the groove 240A of the paper feed roller 240 is a first contact surface 231, and that at the front side of the groove 240A of the paper feed roller 240 is a second contact surface 232. It is noted that the first contact surface 231 and second contact surface 232 double as the first contact portion 31 and second contact portion 32, respectively, and therefore the first contact portion 31 or the second contact portion 32 may be omitted.

The opening 78 of the tray 10 is provided as a through hole beneath the groove 240A of the paper feed roller 240. The end 70A of the actuator 70 projects upward from the opening 78 of the tray 10 and is located within a range in which the groove 240A extends in the front-to-rear direction.

In the automatic document feeder configured as above in the second embodiment, the first contact surface 231 and the second contact surface 232 are placed pretty close to the end 70A of the actuator 70. Therefore, the automatic document feeder of the second embodiment can further certainly provide the same effect as the automatic document feeder 1 of the first embodiment.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A document feeder configured to feed a document in a first direction, comprising:

a tray configured to load a document or a set of documents on a loading surface thereof;

a spindle rotatably provided over the tray to extend in a second direction that is parallel to the loading surface and perpendicular to the first direction;

a holder body swingably provided on the spindle, a first contact surface of the holder body configured to contact a top document sheet on the loading surface;

a feed roller rotatably provided on the holder body at an upstream side in the first direction, the feed roller being configured to be driven by the spindle in contact with a document on the loading surface and feed the document in the first direction, wherein the feed roller and the first contact surface are disposed to concurrently contact the top document sheet while the top document sheet is being fed in the first direction; and a detecting unit configured to detect whether a document is loaded on the loading surface, the detecting unit including an actuator provided between the feed roller and the first contact surface in the second direction, the actuator projecting upward from the loading surface and being configured to be moved down due to contact with the document on the loading surface.

2. The document feeder according to claim 1, further comprising:

a second contact surface, the first and second contact surfaces disposed along the second direction to contact the document on the loading surface, wherein the feed roller is disposed between the first and second contact surfaces in the second direction.

3. The document feeder according to claim 2, wherein the second contact surface is included in the holder body.

4. The document feeder according to claim 3, wherein the first and second contact surfaces are located outside respective side ends of the feed roller in the second direction, and wherein the actuator is provided between the first contact surface and one of the side ends of the feed roller at a side of the first contact surface in the second direction.

5. The document feeder according to claim 4, further comprising:

a separation roller provided at a downstream side in the first direction within the holder body, the separation roller being configured to be rotated integrally with the spindle and separate a document from other documents on the tray on a sheet-by-sheet basis, wherein the actuator is provided between a side end of the separation roller at the side of the first contact surface and the side end of the feed roller at the side of the first contact surface in the second direction.

6. The document feeder according to claim 1, further comprising:

a separation roller provided at a downstream side in the first direction within the holder body, the separation roller being configured to be rotated integrally with the spindle and separate a document from other documents on the tray on a sheet-by-sheet basis;

a second contact surface, the first and second contact surfaces disposed along the second direction to contact the document on the loading surface, wherein the feed roller is disposed between the first and second contact surfaces in the second direction;

a driving gear fixed to a side end of the separation roller at a side of the second contact surface; and a driven gear fixed to a first side end of the feed roller at the side of the second contact surface so as to be driven by the driving gear, wherein the actuator is located outside a second side end of the feed roller opposite to the first side end thereof at a side of the first contact surface in the second direction.

7. The document feeder according to claim 1, further comprising:

a separation roller provided at a downstream side in the first direction within the holder body, the separation roller being configured to be rotated integrally with the spindle and separate a document from other documents on the tray on a sheet-by-sheet basis.

8. The document feeder according to claim 1, wherein the holder body includes a space configured to accommodate the actuator between the first contact surface and the feed roller.

9. An image forming device, comprising:

a scanner unit configured to scan an image formed on a document; and a document feeder configured to feed a document in a first direction to the scanner unit, the document feeder comprising:

a tray configured to load a document or a set of documents on a loading surface thereof;

a spindle rotatably provided over the tray to extend in a second direction that is parallel to the loading surface and perpendicular to the first direction;

a holder body swingably provided on the spindle, a first contact surface of the holder body configured to contact a top document sheet on the loading surface;

a feed roller rotatably provided on the holder body at an upstream side in the first direction, the feed roller being configured to be driven by the spindle in contact with a document on the loading surface and feed the document in the first direction, wherein the feed roller and the first contact surface are disposed to concurrently contact the top document sheet while the top document sheet is being fed in the first direction; and a detecting unit configured to detect whether a document is loaded on the loading surface, the detecting unit including an actuator provided between the feed roller and the first contact surface in the second direction, the actuator projecting upward from the loading surface and being configured to be moved down due to contact with the document on the loading surface.

10. The image forming device according to claim 9, further comprising:

a second contact surface, the first and second contact surfaces disposed along the second direction to contact the document on the loading surface, wherein the feed roller is disposed between the first and second contact surfaces in the second direction.

11. The image forming device according to claim 10, wherein the second contact surface is included in the holder body.

12. The image forming device according to claim 11, wherein the first and second contact surfaces are located outside respective side ends of the feed roller in the second direction, and wherein the actuator is provided between the first contact surface and one of the side ends of the feed roller at a side of the first contact surface in the second direction.

13. The image forming device according to claim 12, further comprising:

a separation roller provided at a downstream side in the first direction within the holder body, the separation roller being configured to be rotated integrally with the spindle and separate a document from other documents on the tray on a sheet-by-sheet basis, wherein the actuator is provided between a side end of the separation roller at the side of the first contact surface and the side end of the feed roller at the side of the first contact surface in the second direction.

14. The image forming device according to claim 9, wherein the document feeder further comprises:

a separation roller provided at a downstream side in the first direction within the holder body, the separation roller being configured to be rotated integrally with the spindle and separate a document from other documents on the tray on a sheet-by-sheet basis;

a second contact surface, the first and second contact surfaces disposed along the second direction to contact the document on the loading surface, wherein the feed roller is disposed between the first and second contact surfaces in the second direction;

a driving gear fixed to a side end of the separation roller at a side of the second contact surface; and a driven gear fixed to a first side end of the feed roller at the side of the second contact surface so as to be driven by the driving gear, wherein the actuator is located outside a second side end of the feed roller opposite to the first side end thereof at a side of the first contact surface in the second direction.

15. The image forming device according to claim 9, further comprising:

a separation roller provided at a downstream side in the first direction within the holder body, the separation roller being configured to be rotated integrally with the spindle and separate a document from other documents on the tray on a sheet-by-sheet basis.

16. The image forming device according to claim 9, wherein the holder body includes a space configured to accommodate the actuator between the first contact surface and the feed roller.

17. A document feeder configured to feed a document in a first direction, comprising:

a tray configured to load a document or a set of documents on a loading surface thereof;

a spindle rotatably provided over the tray to extend in a second direction that is parallel to the loading surface and perpendicular to the first direction;

a holder body swingably provided on the spindle, a first contact surface of the holder body configured to contact a top document sheet on the loading surface;

only a single feed roller rotatably mounted on the holder body at an upstream side in the first direction, the single feed roller being configured to be driven by the spindle in contact with a document on the loading surface and feed the document in the first direction; and a detecting unit configured to detect whether a document is loaded on the loading surface, the detecting unit including an actuator provided between the single feed roller and the first contact surface in the second direction, the actuator projecting upward from the loading surface and being configured to be moved down due to contact with the document on the loading surface.

* * * * *